United States Patent [19]

Kersten et al.

[11] 4,347,676

[45] Sep. 7, 1982

[54] BUCKET-WHEEL EXCAVATOR

[75] Inventors: Peter Kersten; Peter Meixner; Erich Müller, all of Magdeburg, German Democratic Rep.

[73] Assignee: Veb Schwermachinenbaukombinat Takraf, Leipzig, German Democratic Rep.

[21] Appl. No.: 211,653

[22] Filed: Dec. 1, 1980

[51] Int. Cl.[3] ..... E02F 5/08

[52] U.S. Cl. ..... 37/94

[58] Field of Search ..... 37/94–97, 37/189–190; 198/713, 714; 299/79

[56] References Cited

U.S. PATENT DOCUMENTS 2,732,641 1/1956 Jespersen ..... 37/189
4,179,829 12/1979 Kinkade ..... 37/189

FOREIGN PATENT DOCUMENTS 1112463 6/1957 Fed. Rep. of Germany ..... 37/189
1327261 8/1973 United Kingdom ..... 37/94
608884 5/1978 U.S.S.R. ..... 37/94

*Primary Examiner*—E. H. Eickholt
*Attorney, Agent, or Firm*—Karl F. Ross

[57] ABSTRACT

A bucket-wheel excavator has a frame provided with an unsplit-ring bearing that defines an axis for a shaft assembly. This assembly is formed by a solid core shaft extending along the axis through the bearing, an input-side tube shaft fitted over the core shaft to one side of the bearing and having one end turned away from the bearing and formed with an input flange, and an output-side tube shaft fitted over the core shaft to the opposite side of the bearing and having one end also turned away from the bearing and formed with an output flange. The opposite ends of these tube shafts are provided with angularly interengaging formations that rotationally couple them together and bolts press these formations axially into tight engagement with one another. A bucket wheel is carried on the output flange and a drive motor is connected to the input flange for rotating the shaft assembly and bucket wheel about the axis.

7 Claims, 2 Drawing Figures

BUCKET-WHEEL EXCAVATOR

FIELD OF THE INVENTION

The present invention relates to a bucket-wheel excavator. More particularly this invention concerns such a continuous-digging machine normally used for strip-mining of brown coal.

BACKGROUND OF THE INVENTION

A bucket-wheel excavator is a continuous-digging machine normally used in large-scale stripping and mining of brown-coal deposits. It has a boom on which is mounted a rotating vertical wheel provided on its periphery with buckets. The rotating wheel is pressed into the material to be dug so that the buckets cut, gather, and discharge material dug up onto a conveyor belt that carries it away from the excavator. Such machines have capacities as large as 200,000 $m^3$.

The enormous bucket wheel is supported on the frame of the bucket-wheel excavator by means of a very heavy-duty bearing. This bearing is provided on the shaft assembly which extends between the bucket wheel at one end and the drive wheel at the other end, which drive wheel is normally connected by several belts or a chain to the drive motor. Due to the large size of the bucket wheel at one end and the drive wheel at the opposite end it is therefore necessary to use a split-ring bearing between these ends, as a nonsplit-ring bearing could not be fitted over the ends of the shaft assembly. This bearing is a relatively expensive and complex structure.

It has been suggested to avoid this use of a split-ring bearing by journaling the shaft assembly at several locations, and making the bucket wheel or excavator wheel removable so that the shaft can be fitted through these bearings and then have the bucket wheel or drive wheel mounted on it. Such structures themselves become relatively complex, and often create considerable problems in securing the removable wheel to the shaft, as enormous torque must be transmitted from the shaft to the wheel. These structures, which normally require bearings to be mounted on the outer ends of the shaft outside the bucket and drive wheels therefore take up considerable room and are quite expensive. Furthermore a relatively long shaft length is necessary between the drive wheel and the bucket wheel.

OBJECTS OF THE INVENTION

It is therefore an object of the present invention to provide an improved bucket-wheel excavator.

Another object is to provide such an excavator whose shaft assembly can be supported by a nonsplit-ring bearing, but which nonetheless does not have the disadvantage of known excavators.

SUMMARY OF THE INVENTION

These objects are attained according to the instant invention in a bucket-wheel excavator wherein same is provided with an unsplit-ring bearing that defines an axis. The shaft assembly has a solid core shaft extending along this axis through the bearing and has an input-side tube shaft fitted over the core shaft to one side of the bearing and having one end turned away from the bearing and formed with an input flange and an opposite end. An output-side tube shaft is fitted over the core shaft to the opposite side of the bearing and has one end turned away from the bearing and formed with an outward flange, and an opposite end. Angularly interengaging formations at least partially on the opposite ends rotationally couple same together and means is provided for pressing the opposite ends axially against each other. A bucket wheel is carried on the output flange and drive means is connected to the input flange for rotating the shaft assembly and bucket wheel about the axis.

Thus it is possible according to the instant invention to use a heavy-duty and relatively inexpensive unsplit-ring bearing while ensuring extremely good force transmission between the input and output ends of the shaft assembly. The core shaft serves mainly to support and maintain the two tube shafts aligned, and torque is transmitted between these two tube shafts not via the core shaft but mainly via the above-mentioned angularly interengaging formations. The use of a heavy-duty unsplit-ring bearing makes it unnecessary to support both outer ends of the shaft assembly on further bearings, making the assembly relatively inexpensive to manufacture and axially very short.

The formations according to the instant invention can simply be axially interengaging teeth on the confronting ends of the tube shafts. Bolts engaging axially between the tube shafts simply force these ends together so that, as mentioned above, virtually all of the torque transmitted from the input flange to the output flange passes via these formations. It is also possible to form the one end with outwardly directed splines and the other end with inwardly directed splines and simply fit the two together, or to form both ends with outwardly directed splines and connect them together by means of a separate collar having inwardly directed teeth or splines.

SPECIFIC DESCRIPTION

Figure 1:
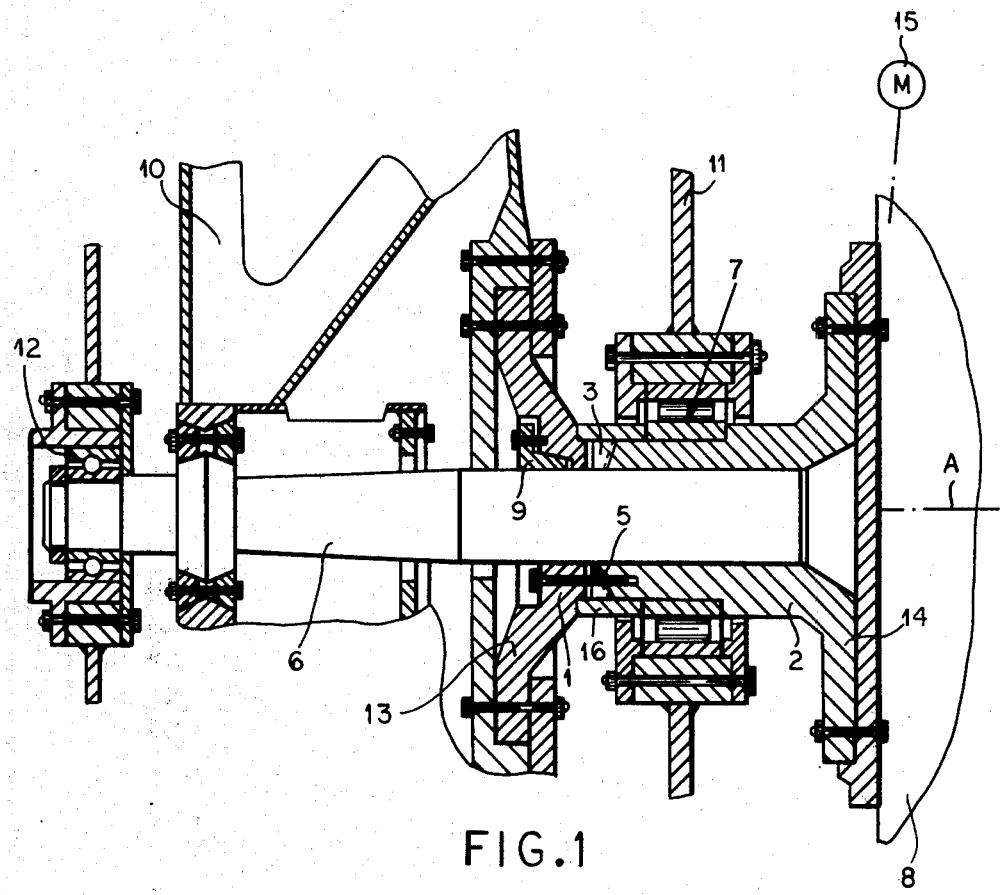
FIG. 1 is an axial section through the shaft assembly of the bucket excavator according to the instant invention.

As seen in FIG. 1 a bucket excavator has a fixed frame 11 provided with a nonsplit-ring bearing 7 defining an axis A, and with another nonsplit-ring bearing 12 also centered on this axis A. A solid steel core shaft 6 is centered on this axis A and directly engages the inner race of the bearing 12. This core shaft 6 carries the bucket wheel 10 of the excavator.

A pair of tube shafts 1 and 2 are tightly fitted over the core shaft 6 and have outer ends 13 and 14 constituted as flanges, the former of which is fixed to the bucket wheel 10 and the latter of which is operatively connected to a drive motor 15. These two shafts 1 and 2 have confronting ends formed with interengaging teeth 3 and are urged into tight axial connection with each other by means of axially extending bolts 5 passing through the tube shaft 1 and threaded into the tube shaft 2. A collar 16 surrounds the ends of the shafts 1 and 2 at the teeth 3 to keep them in perfect alignment. These teeth 3 lie slightly to one side of the nonsplit-ring bearing 7.

Thus with the system according to the instant invention torque transmitted, normally by means of belts or a chain, from the motor 15 to the input flange 14 will be transmitted directly from the tube shaft 2 to the tube shaft 1 via the teeth 3 for rotation of the bucket wheel 10. The core shaft 6 will only serve a supporting and centering function; it will not itself serve a torque-transmitting function.

Figure 2:
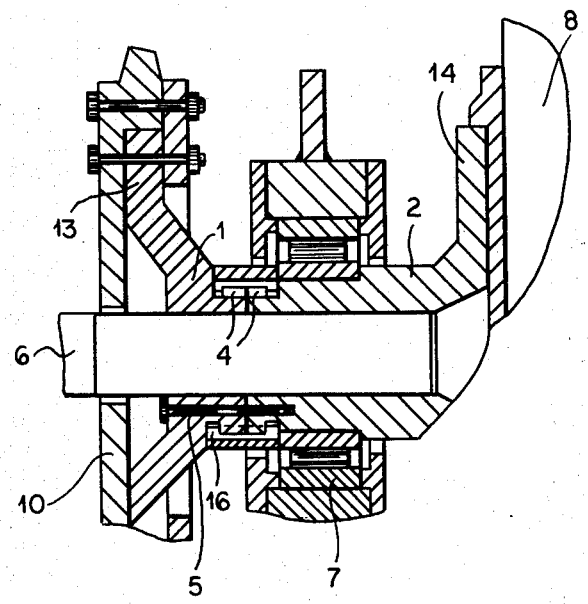
FIG. 2 is a sectional view of an alternative form of a detail of FIG. 1.

FIG. 2 shows a similar arrangement wherein the tube shafts 1 and 2 are formed with outwardly projecting teeth or splines 4 engaged between inwardly projecting teeth or splines 16 of a retaining collar 4. This retaining collar 4 therefore transmits torque between the drive wheel carried on the input flange 14 of the tube shaft 2 and the output tube shaft 1.

Thus with the system of the instant invention torque is transmitted directly from one tube shaft to the other. This allows the assembly to be made with an unsplit-ring bearing 7 which can be of very heavy-duty construction and, simultaneously, relatively cheap. As a result there is no need to provide a bearing at the outer, left-hand in FIGS. 1 and 2, end of the core shaft 6. The assembly therefore has a relatively short overall length.

We claim:

1. A bucket-wheel excavator comprising:

a frame;

an unsplit-ring bearing on said frame defining an axis;

a shaft assembly having a solid core shaft extending along said axis through said bearing an input-side tube shaft fitted over said core shaft to one side of said bearing and having one end turned away from said bearing and formed with an input flange and an opposite end, an output-side tube shaft fitted over said core shaft to the opposite side of said bearing and having one end turned away from said bearing and formed with an output flange and an opposite end, angularly interengaging formations at least partially on said opposite ends rotationally coupling same together, and means for pressing said opposite ends axially against each other;

a bucket wheel carried on said output flange; and drive means connected to said input flange for rotating said shaft assembly and bucket wheel about said axis.

2. The excavator defined in claim 1 wherein said means for pressing includes axially extending bolts engaging between said opposite ends.

3. The excavator defined in claim 1 wherein said formations include interengaging teeth on said opposite ends.

4. The excavator defined in claim 1 wherein said opposite ends are formed with radially outwardly projecting teeth constituting some of said formations and said excavator comprises a collar formed with inwardly projecting teeth constituting the rest of said formations and meshing with said outwardly projecting teeth.

5. The excavator defined in claim 1 wherein each of said tube shafts has a tube portion forming the respective opposite end and tightly received around said core shaft.

6. The excavator defined in claim 1 wherein said formations are axially offset from said bearing.

7. The excavator defined in claim 6 wherein said formations are between said bearing and said bucket wheel.

* * * * *